US008748784B2

(12) United States Patent
Bauer et al.

(10) Patent No.: US 8,748,784 B2
(45) Date of Patent: Jun. 10, 2014

(54) SURFACE HEATING SYSTEM AND VEHICLE WITH A SURFACE HEATING SYSTEM

(75) Inventors: Hans-Achim Bauer, Hamburg (DE); Andre Zybala, Hanstedt (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 13/470,471

(22) Filed: May 14, 2012

(65) Prior Publication Data

US 2012/0285947 A1 Nov. 15, 2012

Related U.S. Application Data

(60) Provisional application No. 61/485,555, filed on May 12, 2011.

(30) Foreign Application Priority Data

May 12, 2011 (DE) ..... 10 2011 101 356

(51) Int. Cl.
*H05B 6/04* (2006.01)
*H05B 6/10* (2006.01)

(52) U.S. Cl.
USPC ..... 219/635; 219/671

(58) Field of Classification Search
USPC ..... 219/619, 620–628, 635, 600, 671, 216
See application file for complete search history.

(56) References Cited

U.S. PATENT DOCUMENTS

| | | | | |
|---|---|---|---|---|
| 4,759,964 | A * | 7/1988 | Fischer et al. | 428/116 |
| 5,528,020 | A * | 6/1996 | Dickens et al. | 219/621 |
| 6,359,268 | B1 * | 3/2002 | Walter | 219/622 |
| 8,164,215 | B2 | 4/2012 | Bauer et al. | |
| 2002/0168184 | A1 * | 11/2002 | Meisiek | 392/435 |
| 2010/0285747 | A1 | 11/2010 | Bauer et al. | |

FOREIGN PATENT DOCUMENTS

| | | | |
|---|---|---|---|
| DE | 7725866 | U1 | 1/1978 |
| DE | 19918736 | A1 | 11/2000 |
| DE | 202009002032 | U1 | 7/2009 |
| DE | 102008024217 | A1 | 12/2009 |
| DE | 102009019994 | A1 | 12/2009 |
| DE | 102009029253 | A1 | 3/2011 |
| JP | 09042696 | A | 2/1997 |

OTHER PUBLICATIONS

Translation of JP Publication No. 09-042696, Betsusou Daisuke, BAthroom Heating Apparatus, published Feb. 14, 1997.*

German Patent Office, German Office Action dated Feb. 16, 2012 for German Patent Application No. 10 2011 101 356.7.

* cited by examiner

*Primary Examiner* — Dana Ross
*Assistant Examiner* — Michael Laflame, Jr.
(74) *Attorney, Agent, or Firm* — Ingrassia Fisher & Lorenz P.C.

(57) ABSTRACT

A surface heating system is provided. The surface heating system includes a heatable surface element with a supporting structure on which a conductive layer is arranged that is completely covered by a cover layer. A first induction coil is configured separately of the heatable surface element and is connectable to an AC voltage source. The heatable surface element is configured for generating an eddy current that results in heating of the heatable surface element within the conductive layer when the first induction coil is acted upon with an AC voltage

11 Claims, 2 Drawing Sheets

SURFACE HEATING SYSTEM AND VEHICLE WITH A SURFACE HEATING SYSTEM

CROSS-REFERENCE TO RELATED APPLICATIONS

The present application claims priority to U.S. Provisional Patent Application No. 61/485,555 filed May 12, 2011 and also claims priority to German Patent Application No. 10 2011 101 356.7, filed May 12, 2011, which are incorporated herein by reference in their entirety.

TECHNICAL FIELD

The technical field relates to a surface heating system and a vehicle with a vehicle cabin and a surface heating system arranged therein.

BACKGROUND

It is known to use electrically heatable surface elements in order to heat rooms or objects. These surface elements may be realized in the form of heatable floor elements, wall panels, ceiling panels or the like and typically comprise heating wires or heating films with a relatively high electrical resistance such that heat is generated when an electric voltage is applied. It is furthermore known to provide vehicles with floor panels that can be electrically heated. This concerns, for example, motor homes or travel trailers, but also passenger aircraft as described in DE 19 918 736 A1. In addition, other objects, desirable features and characteristics will become apparent from the subsequent summary and detailed description, and the appended claims, taken in conjunction with the accompanying drawings and this background.

SUMMARY

It is at least one object herein to propose an improved surface heating system that is constructed in the simplest possible fashion and is highly reliable, but also has a minimal weight.

In an exemplary embodiment, the surface heating system includes a heatable surface element with a supporting structure, on which a conductive layer is arranged that is covered by a cover layer. The surface heating system furthermore comprises a first induction coil that is realized separately of the heatable surface element and is connectable to an AC voltage source. The heatable surface element is configured for generating an eddy current that leads to heating of the surface element within the conductive layer when the first induction coil is acted upon with an AC voltage.

The supporting structure is a component of the surface element that fulfills essentially mechanical functions and ensures the mechanical integrity of the surface element. An operational supporting structure may be configured as a trim element, ceiling element or floor element and realized in the form of a sandwich element with a honeycomb or foamed core structure that is surrounded by cover layers. Other non-conductive materials that allow an induction of a voltage in the conductive layer may also be used.

The realization of the first induction coil separately of the surface element should be interpreted in such a way that the first induction coil is provided as a separate component that is arbitrarily positionable relative to the surface element. A certain variability in the positioning of the first induction coil relative to the surface element generally is not detrimental to making available the heating function in proper form such that first induction coils are positionable within the room to be equipped with the surface elements. The positioning can be based on the structural circumstances within the room that may offer conceivable mounting positions. An equidistantly distributed arrangement of first induction coils within the room in question is considered advantageous, wherein the distance between the first induction coils should be configured to the size of the surface elements used such that each surface element correlates with at least one first induction coil. The first induction coils may furthermore assume various shapes in order to ensure sufficient induction characteristics. In addition to disc-shaped or circular first induction coils to be arranged selectively, it is also possible to utilize elongate, oval first induction coils, relative to which an overlapping arrangement of surface elements would also be conceivable. Suggestions for realizing and positioning first induction coils in a room can be found, e.g., in DE 10 2008 024 217 A1 and DE 10 2009 019 994 A1.

The surface heating system makes it possible to improve the integrity of the surface element or the heating wires, for example, due to the fact that connections for heating wires or heating films do not have to extend or completely extend out of the respective surface element or be externally accessible. Since it is preferably not necessary to utilize mechanical plug-type connectors for producing direct electrical connections for the surface heating system, it is also possible to eliminate, for example, comparatively heavy plugs and sockets as they are typically used for ensuring a sufficiently reliable plug connection under the influence of vibrations and motive forces in an aircraft.

In an embodiment, the conductive layer is completely encapsulated in the surface element. It is not necessary for connecting wires to extend outward. The surface element is not dependent on a direct current supply and the conductive layer required for the heating function is shielded from external influences.

In order to check whether a certain temperature has been reached, the surface element, according to an embodiment, furthermore comprises a temperature sensor that is completely integrated into the surface element. In this case, the temperature sensor is connected to a second induction coil and a second electronics unit. The second electronics unit is configured for being supplied with electrical power by a voltage induced in the second induction coil, e.g., by the first induction coil, for reading the temperature sensor and for generating an AC voltage with a harmonic component, by means of which the read temperature value is transmitted to a correspondingly positioned first induction coil. Alternatively, the transmission may also take place to a third induction coil that is exclusively provided for determining temperature values of surface elements. This makes it possible to determine the temperature of a surface element without requiring a direct electrical connection with a temperature sensor outside the surface element.

In an embodiment, the first induction coil is connected to a first electronics unit that is configured for extracting a harmonic component induced in the first induction coil and for determining the read temperature value thereof The utilization of the first induction coil makes it possible to transmit the temperature values outward in a particularly weight-saving fashion. In this case, the data transmission principle may be realized in accordance with the disclosure of DE 10 2008 024 217 A1.

In another embodiment, the first electronics unit is connected to a control device that, in turn, is connected to the first induction coil in order to control the temperature of the surface element. If a specified temperature value needs to be adjusted, this makes it possible to realize a temperature control for the surface element by controlling or switching the transmitted electrical power. It also needs to be ensured that the temperature reached does not exceed a predefined maximum temperature, particularly when the surface element is used as a floor heating element. For example, this maximum temperature may be approximately 35° C. for floor heating systems in buildings.

In a further embodiment, the conductive layer is configured in the form of a film of a metallic material or a film with a metallization. This makes it possible to ensure a particularly uniform conductivity over the entire surface of the surface element.

In an alternative embodiment, the electrically conductive layer is realized in the form of a mesh-like fabric of a metallic material or of metallized fibers. This makes it possible to additionally lower the weight of the surface element such that this embodiment is particularly suitable for use in aircraft and has a certain robustness.

In an embodiment, the electrically conductive layer comprises a cutout for accommodating the temperature sensor and the second induction coil. The temperature measurement and the transmission of the temperature therefore can be realized in an undisturbed fashion and independently of a voltage induced in the electrically conductive layer.

One particular advantage of the surface element can be seen in that the possible breakage of a heating wire of a conductive fabric or of a partial area of a conductive layer does not result in the complete breakdown of the surface heating system, but rather no more than a selectively limited heating capacity. Consequently, the floor element is much more robust than all other known surface heating systems or floor elements with integrated electric resistance heating.

In another embodiment, a vehicle comprises a vehicle cabin with the surface heating system arranged therein. First induction coils are distributed in the cabin in such a way that they induce a voltage in the electrically conductive layer due to their immediate vicinity to directly adjacent surface elements, wherein the voltage leads to a current flow that results in a heating effect. One or more first induction coils may be used for each surface element such that a voltage for generating an eddy current can be induced in each surface element.

A corresponding arrangement of induction coils within the cabin makes it possible to uniformly heat floor or wall elements formed by the heatable surface element.

In an embodiment, a first induction coil is connected to a first electronics unit that is configured for extracting an electrical signal transmitted by a second induction coil in the heatable surface element from a harmonic component. As already mentioned above, this makes it possible to transmit a measured temperature from the surface element to a master system. This integral system of the vehicle may be realized, e.g., in the form of an electronics unit for controlling induction coils that are positioned on the surface elements and cause a heating effect.

In another embodiment, the surface element is configured in the form of a floor element for lining a cabin floor. Consequently, the vehicle is able to operate a floor heating system in a particularly effective fashion without requiring separate electrical connections.

The surface element is arranged in the region of a door, in accordance with an embodiment. A defined temperature loss is expected at such a location, particularly in an aircraft, because this region is not heated due to the presence of the passengers such that the temperature to be expected at this location is lower than in a region of the vehicle cabin that comprises passenger seats.

In another embodiment, the surface element is arranged in the region of an emergency exit door. Temperature losses occur, e.g., in a region of the aircraft cabin near a wing for construction-related reasons such as the installation of escape chute systems in the region of the skin of the aircraft fuselage.

The term vehicle is not limited to land-based vehicles only, but may also include watercraft and aircraft. The surface heating system is particularly suitable for aircraft due to its robust properties and low weight.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
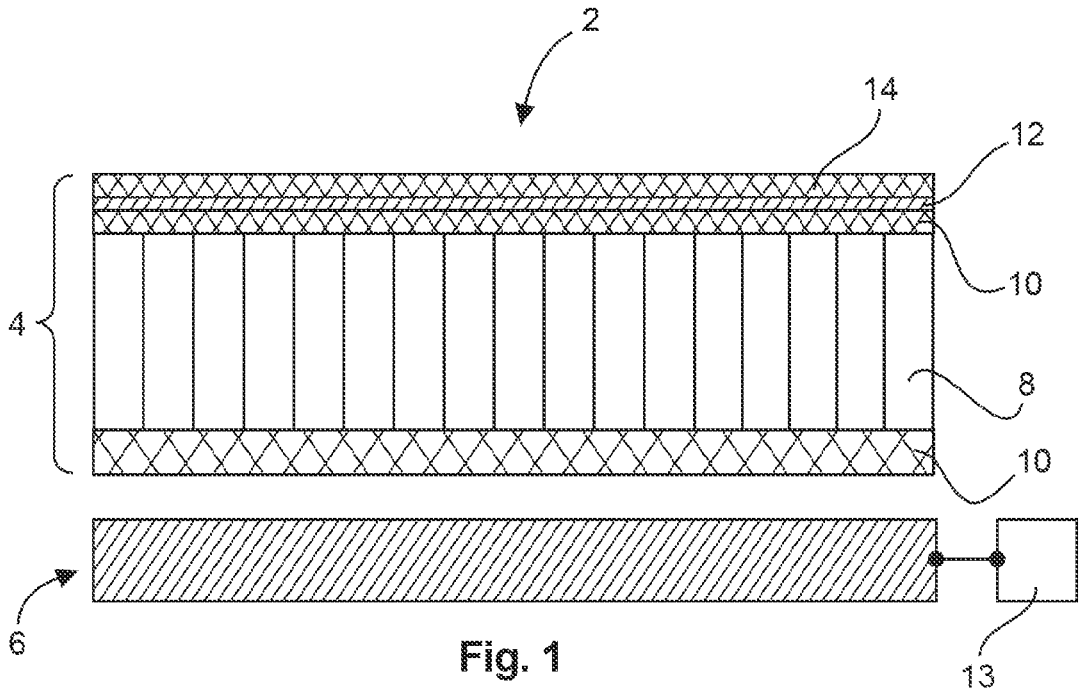
FIG. 1 shows a sectional representation of a surface heating system in accordance with an exemplary embodiment.

FIG. 1 shows a sectional representation of a surface heating system 2 with a heatable surface element 4 and a first induction coil 6. In this exemplary embodiment, the surface element 4 has a supporting structure that consists of a honeycomb core 8 with glass fiber or carbon fiber layers 10 bonded to the surface thereof. These glass fiber or carbon fiber layers form a sandwich element with high rigidity, but low weight together with the honeycomb core. In addition, a conductive layer 12 in the form of a conductive film or a conductive meshed braiding is incorporated into the upper side of the surface element and is covered with a cover layer 14. The conductive layer 12 is able to produce an inductive coupling with the first induction coil 6. When a voltage is induced, the conductive layer 12 produces an electric short circuit that leads to the generation of eddy currents in the electrically conductive layer such that the entire induced energy is converted into heat.

The first induction coil 6 is connected to an electronics unit 13 that is referred to as first electronics unit 13. The first electronics unit 13 is connected to the first induction coil 6 and is configured for filtering a harmonic component out of an AC voltage induced in the first induction coil 6 and for converting this harmonic component into digital data. This makes it possible to transmit data from the surface element 4 to the first electronics unit 13 by inducing an AC voltage in the first induction coil 6. The detailed correlation between a harmonic component to be transmitted and digital data obtained thereof is described, for example, in DE 10 2008 024 217 A1.

Figure 2:
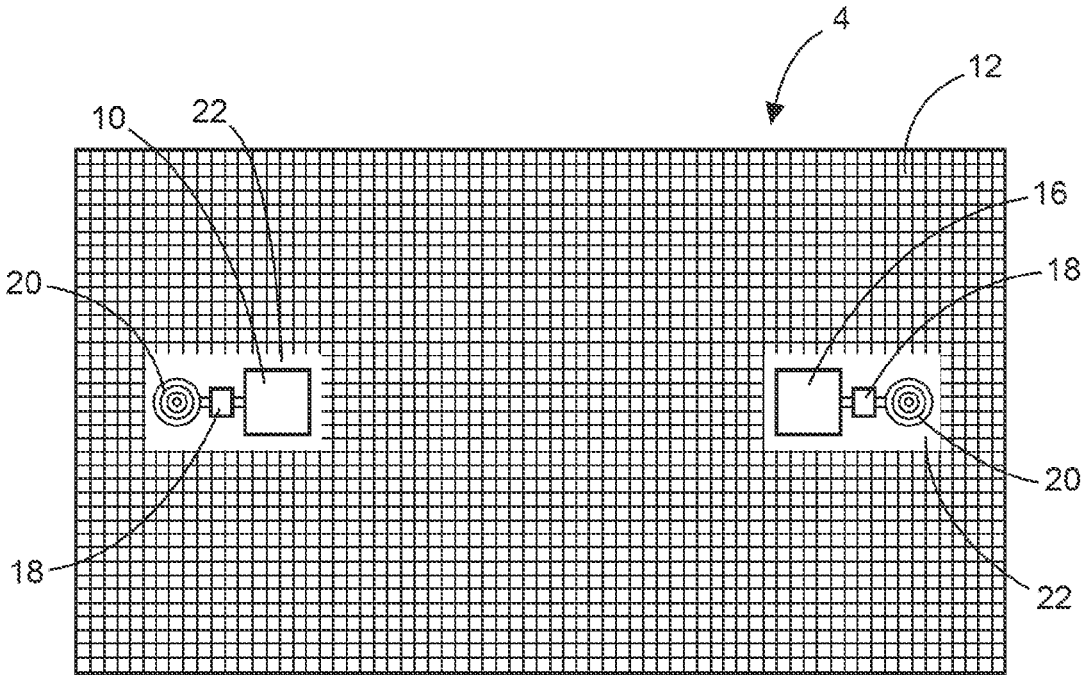
FIG. 2 shows a top view of a heatable surface element in accordance with an exemplary embodiment.

The illustration according to FIG. 2 shows a top view of a surface element 4. In addition to the essential characteristics, this figure also shows a temperature sensor 16 that is configured for measuring the temperature in the surface element 4 according to an embodiment. The temperature sensor 16 is connected to a second electronics unit 18 that, as an alternative to the separate illustration in FIG. 2, may also form an integral component of the temperature sensor 16. The second electronics unit 18 is furthermore connected to a second induction coil 20. The second electronics unit 18 is supplied with energy by inducing an AC voltage from the first induction coil 6 in the second induction coil 20 such that the value of the temperature sensor 16 can be read and an electrical AC voltage signal can be generated thereof, wherein this electrical AC voltage signal transmits the measured temperature value to the first induction coil 6 outside the surface element 2 in the form of a harmonic component.

For this purpose, the film or the meshed braiding comprises a cutout 22, into which the temperature sensor 16, the second electronics unit 18 and the second induction coil 20 are placed. When using particularly thin conductive layers 12, it would also be conceivable to produce a recess in the cover layer 10 and the core layer 8.

Figure 3:
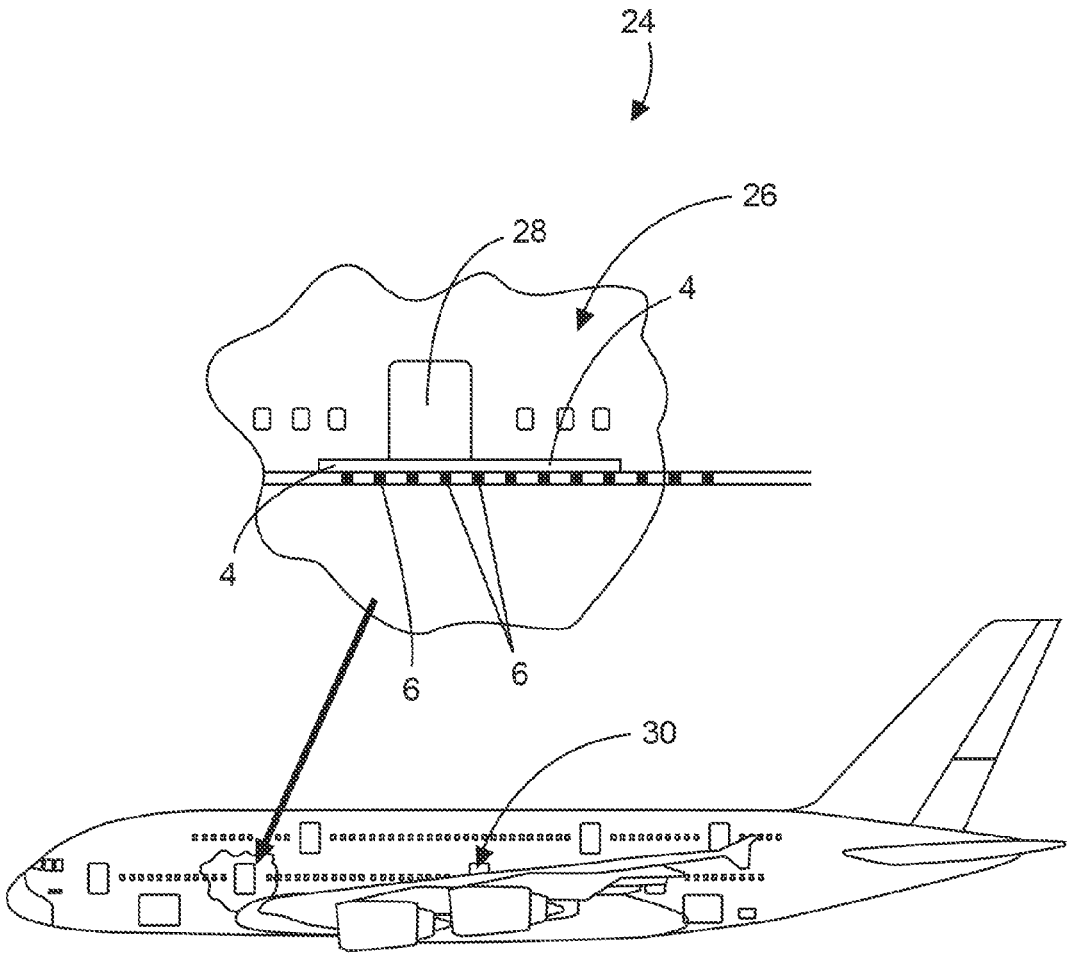
FIG. 3 shows an aircraft with a cabin and a surface heating system according to an exemplary embodiment installed therein.

FIG. 3 shows an aircraft 24 that comprises a cabin 26 with a floor arranged therein. In this exemplary embodiment, a surface element 4 is arranged in a region near a cabin door 28 or an emergency exit door 30 in the form of a floor element such that this region can be individually heated. In regions near doors, the occurring heat loss generally is greater than in a passenger area because a heat loss at these locations is not partially compensated by the heat input of passengers aboard the aircraft 24.

As a supplement, it should be noted that "comprising" does not exclude any other elements or steps, and that "a" or "an" does not exclude a plurality. It should furthermore be noted that characteristics or steps that were described with reference to one of the above exemplary embodiments can also be used in combination with other characteristics or steps of other above-described exemplary embodiments. Reference symbols in the claims should not be interpreted in a restrictive sense. In addition, while at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A surface heating system comprising:

a heatable surface element with a supporting structure on which a conductive layer is arranged that is completely covered by a cover layer and the conductive layer is completely encapsulated in the heatable surface element; and a first induction coil that is configured separately of the heatable surface element and is connectable to an AC voltage source, wherein the heatable surface element is configured for generating an eddy current that results in heating of the heatable surface element within the conductive layer when the first induction coil is acted upon with an AC voltage, and wherein the heatable surface element further comprises:

a temperature sensor that is integrated into the heatable surface element, wherein the temperature sensor is connected to a second induction coil for transmitting a temperature signal through the second induction coil.

2. The surface heating system of claim 1, wherein the temperature sensor is connected to a second electronics unit, and wherein the second electronics unit is configured for being supplied with electrical power by a voltage induced in the second induction coil, for reading the temperature sensor and for generating an AC voltage with a harmonic component, by which a temperature value read from the temperature sensor is transmitted to a correspondingly positioned first induction coil.

3. The surface heating system of claim 2, wherein the first induction coil is connected to a first electronics unit that is configured for extracting a harmonic component induced in the first induction coil and for determining a read temperature value thereof.

4. The surface heating system of claim 3, wherein the first electronics unit is connected to a control device that, in turn, is connected to the first induction coil in order to control a temperature of the heatable surface element.

5. The surface heating system of claim 1, wherein the conductive layer is configured in a form of a film of a metallic material or with a metallization.

6. The surface heating system of claim 1, wherein the conductive layer is configured in a form of a mesh-like fabric of a metallic material or of metallized fibers.

7. A vehicle comprising:

a cabin; and a surface heating system comprising:

a heatable surface element with a supporting structure on which a conductive layer is arranged that is completely covered by a cover layer and the conductive layer is completely encapsulated in the heatable surface element; and a first induction coil that is configured separately of the heatable surface element and is connectable to an AC voltage source, wherein the heatable surface element is configured for generating an eddy current that results in heating of the heatable surface element within the conductive layer when the first induction coil is acted upon with an AC voltage, and wherein the heatable surface element further comprises:

a temperature sensor that is integrated into the heatable surface element, wherein the temperature sensor is connected to a second induction coil for transmitting a temperature signal through the second induction coil.

8. The vehicle of claim 7, wherein the heatable surface element is configured in a form of a floor element for lining a cabin floor.

9. The vehicle of claim 7, wherein the heatable surface element is arranged in a region of a door.

10. The vehicle of claim 7, wherein the heatable surface element is arranged in a region of an emergency exit door.

11. The vehicle of claim 7, wherein the vehicle is an aircraft.

* * * * *